US007890040B2

(12) United States Patent
Lee et al.

(10) Patent No.: US 7,890,040 B2
(45) Date of Patent: Feb. 15, 2011

(54) FUSING UNIT AND IMAGE FORMING APPARATUS USING THE SAME

(75) Inventors: Seung-jun Lee, Suwon-si (KR); Dong-jin Seol, Suwon-si (KR); Dong-kyun Kang, Goyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 801 days.

(21) Appl. No.: 11/843,218

(22) Filed: Aug. 22, 2007

(65) Prior Publication Data

US 2008/0199231 A1 Aug. 21, 2008

(30) Foreign Application Priority Data

Feb. 20, 2007 (KR) ..... 10-2007-0017143

(51) Int. Cl.
*G03G 15/20* (2006.01)

(52) U.S. Cl. ..... 399/329

(58) Field of Classification Search ..... 399/328, 399/329, 333; 219/216
See application file for complete search history.

(56) References Cited

U.S. PATENT DOCUMENTS 6,940,044 B2 * 9/2005 Eskey ..... 219/216
7,242,896 B2 * 7/2007 Haseba et al. ..... 399/329
7,502,585 B2 * 3/2009 Uehara et al. ..... 399/329
7,623,817 B2 * 11/2009 Jung et al. ..... 399/328
2005/0265758 A1 12/2005 Haseba et al.

FOREIGN PATENT DOCUMENTS

| | | |
|---|---|---|
| DE | 19535996 | 4/1996 |
| JP | 2004-184756 | 7/2004 |
| KR | 2006-46269 | 5/2006 |
| KR | 2006-90740 | 8/2006 |

OTHER PUBLICATIONS

Office Action issued in corresponding European Patent Application No. 08101734.5 dated Dec. 10, 2008.

* cited by examiner

*Primary Examiner*—William J Royer
(74) *Attorney, Agent, or Firm*—Staas & Halsey LLP

(57) ABSTRACT

A fusing unit is formed along a printing path in an image forming apparatus and fuses an image transferred to a printing medium. The fusing unit includes: a heat source; a nip plate which is heated by the heat source, and includes a nip part to heat and press the printing medium; and a reflection member to reflect heat generated by the heat source toward the nip part. A belt member is rotatably provided about the heat source, the nip plate and the reflection member, and guides the movement of the printing medium. A driving roller faces the nip part and rotatably drives the belt member. The nip plate and the driving roller form a fusing nip, which quickly heats and provides for quick fusing of a toner image to a printing medium.

20 Claims, 12 Drawing Sheets

FUSING UNIT AND IMAGE FORMING APPARATUS USING THE SAME

CROSS-REFERENCE TO RELATED APPLICATIONS

This application claims the benefit of Korean Patent Application No. 2007-17143, filed Feb. 20, 2007, in the Korean Intellectual Property Office, the disclosure of which is incorporated herein by reference.

BACKGROUND OF THE INVENTION

1. Field of the Invention

Aspects of the present invention relate to a fusing unit which heats and fuses an image transferred to a printing medium, and an image forming apparatus using the same; and more particularly, to a fusing unit which intensively heats a fusing part and enhances heat efficiency, and an image forming apparatus using the same.

2. Description of the Related Art

Generally, an electrophotographic image forming apparatus scans light to a photosensitive body which is charged to a predetermined electric potential to form an electrostatic latent image, and develops the image with a predetermined toner to transfer and fuse the image on a printing medium, thereby printing an image. To fuse the transferred image to a printing medium, the electrophotographic image forming apparatus includes a fusing unit arranged on a printing path, through which the printing medium travels.

As shown in FIG. 1, a conventional fusing unit fuses a toner image T formed on a printing medium M. The fusing unit includes a fusing roller 3 which includes a heating lamp 1 therein, a pressing roller 5 which faces the fusing roller 3 and is elastically biased by an elastic member 7 toward the fusing roller 3 to form a fusing nip N, and a temperature sensor 9.

The fusing roller 3 includes a first core pipe 3*a* made of a metal material, and a first elastic layer 3*b* which is formed on an external surface of the first core pipe 3*a*. Radiant energy, which is generated by the heating lamp 1, is converted into thermal energy by a light-heat conversion layer (not shown) formed in an internal surface layer of the first core pipe 3*a*, thereby heating the first core pipe 3*a*. The first elastic layer 3*b* is heated by heat conduction so as to provide and maintain a predetermined fusing temperature.

The temperature sensor 9 senses a surface temperature of the first elastic layer 3*b*. Power, which is supplied to the heating lamp 1, may be controlled based on the surface temperature sensed by the temperature sensor 9.

The pressing roller 5 includes a second core pipe 5*a* made of a metal material, and a second elastic layer 5*b* which is formed on a surface of the second core pipe 5*a*. The second elastic layer 5*b* is more elastic than the first elastic layer 3*b*. Thus, when the pressing roller 5 and the fusing roller 3 contact each other, the second elastic layer 5*b* becomes deformed.

When the printing medium M on which the toner image T is delivered to the fusing unit, the toner image T is heated and pressed while passing through the fusing nip N formed between the fusing roller 3 and the pressing roller 5 that rotate. Then, the toner image T is fused on the printing medium M to complete the fusing process.

To provide a quicker fusing of color electrophotographic images, it is necessary to enlarge an external diameter of the fusing roller 3 and the pressing roller 5 of the fusing unit or increase the thickness of the first and second elastic layers 3*b* and 5*b* resulting in an increase in the width of the fusing nip N which increases a time in which the printing medium M remains in the fusing nip N. As such, fusing quality is maintained while increasing printing speed.

However, expanding the external diameters of the fusing roller 3 and the pressing roller 5 is limited given consideration of the overall size of the image forming apparatus. Also, the expansion causes slower warm-up and raises production costs.

The expansion of the thickness of the first and second elastic layers 3*b* and 5*b* to increase the time in which the printing medium M remains in the fusing nip N also makes the warm-up slower. Further, the temperature of the first core pipe 3*a* necessarily increases to maintain the surface temperature of the thicker first elastic layer 3*b* at a fusing temperature. Thus, a junction between the first core pipe 3*a* and the first elastic layer 3*b*, and also the first elastic layer 3*b*, deteriorate due to the high temperature, and durability thereof is decreased.

Also, opposite end portions of the fusing roller 3 are intensively pressed when pressing the fusing roller 3 and the pressing roller 5. Thus, a center portion of the fusing roller 3 may be bent. As the fusing nip N in the center portion of the fusing roller 3 becomes smaller than that in the opposite end portions thereof, fusibility of the center portion is significantly decreased.

In the fusing unit employing the fusing roller 3, the heat generated by the heating lamp 1 is radially radiated and heats the fusing roller 3, thereby lowering heat efficiency.

SUMMARY OF THE INVENTION

Accordingly, aspects of the present invention provide a fusing unit which secures fusing stability with respect to a printing medium that is rapidly moved, and enhances heat efficiency without enlarging an overall size, and an image forming apparatus using the same.

The foregoing and/or other aspects of the present invention can be achieved by providing a fusing unit which is formed on a printing path of an image forming apparatus and fuses an image to a printing medium, the fusing unit including: a heat source; a nip plate which is heated by the heat source, and includes a nip part to heat and press the printing medium; a reflection member which is formed on a side of the nip plate and reflects heat generated by the heat source toward the nip part; a belt member which is rotatably provided about the heat source, the nip plate and the reflection member, and guides the movement of the printing medium; and a driving roller which faces the nip part, disposed such that the belt member is between the nip plate and the driving roller, and the driving roller rotatably drives the belt member. The nip part of the nip plate and the driving roller form a fusing nip to heat and fuse the image to the printing medium.

According to an aspect of the invention, the nip plate further includes a heat absorbing layer which is formed on a surface thereof facing the heat source and enhances a heat absorption rate.

According to an aspect of the invention, the fusing unit further includes an elastic member which elastically presses at least one of the nip plate and the driving roller, and forms the fusing nip between the nip part and the driving roller corresponding to a width of the nip part.

According to an aspect of the invention, the belt member includes: a base layer; an elastic layer which is formed on an external surface of the base layer facing the driving roller; and a release layer which is formed on an external surface of the first elastic layer to prevent the printing medium from adhering thereto while being fused.

According to an aspect of the invention, the driving roller includes: a core pipe; an elastic layer which is formed on an external surface of the core pipe; and a release layer which is formed on an external surface of the elastic layer to prevent the printing medium from adhering thereto while being fused.

According to an aspect of the invention, the nip part includes one of a flat shape, a convex shape and a concave shape.

According to an aspect of the invention, an angle θ satisfies a following Formula 1 if $L_1$ is a straight line between an arbitrary position on the reflection member and a center of the heat source, $L_2$ is a straight line which crosses the arbitrary position on the reflection member and is vertical to the nip part, ϕ is an obtuse angle formed between the straight lines $L_1$ and $L_2$, and θ is an acute angle formed between a tangent line tangent to the reflection member at the arbitrary position on the reflection member and the straight line $L_1$: <Formula 1> $\phi/2-15° \leqq \theta \leqq \phi/2+15°$.

According to an aspect of the invention, the reflection member includes a heat reflecting surface which faces the nip part and satisfies the Formula 1; and a coupling part to couple the nip plate and the reflection member and to form a closed fusing unit.

The foregoing and/or other aspects of the present invention can be achieved by providing an image forming apparatus, including: a photosensitive body; a light scanning unit which scans light on the photosensitive body and forms an electrostatic latent image thereon; a developing unit which develops a toner image with respect to the electrostatic latent image formed on the photosensitive body; a transfer unit which moves a printing medium past the photosensitive body to transfer the toner image formed by the developing unit to the printing medium; and the fusing unit according to the above description which fuses a toner image to the printing medium.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
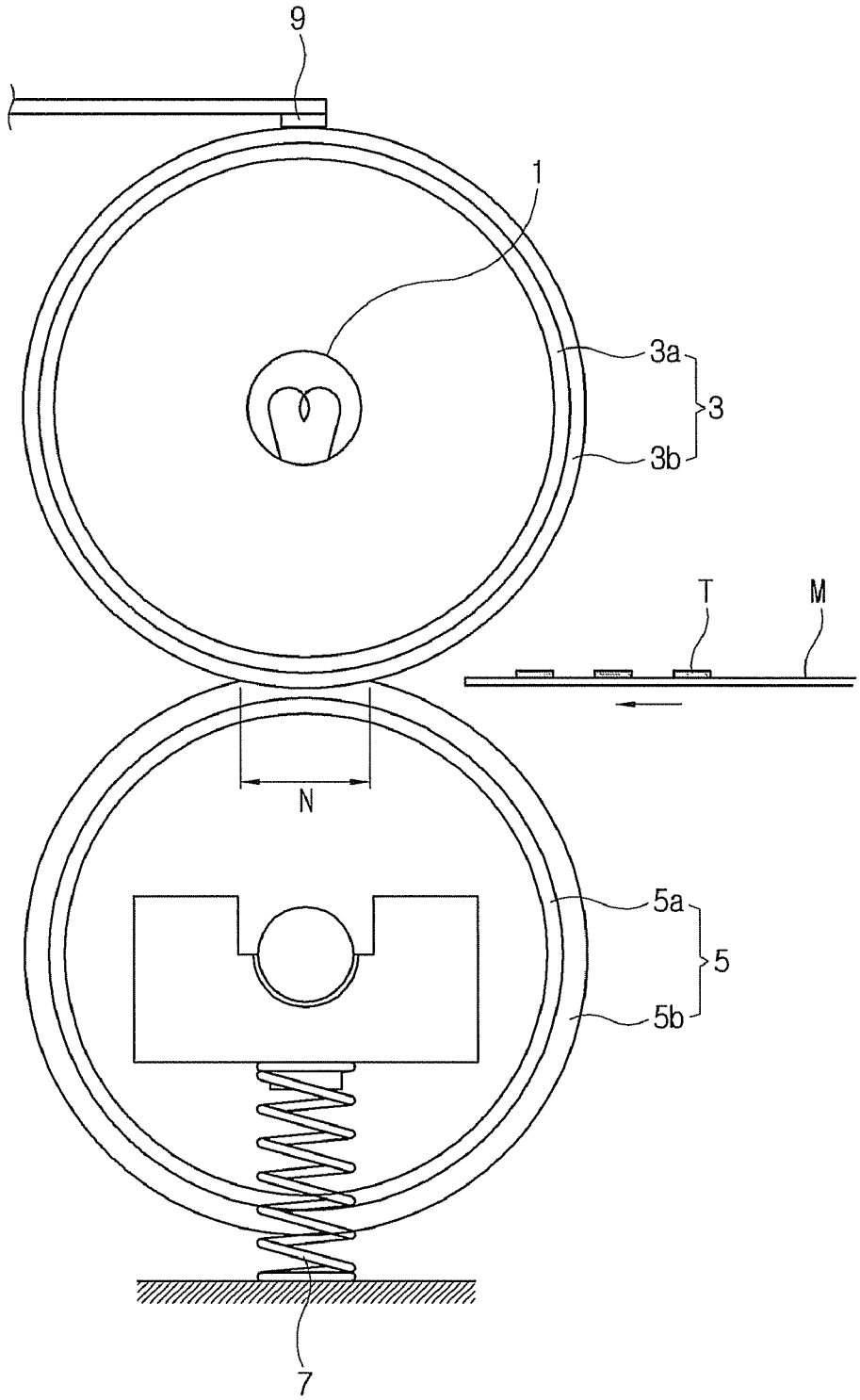
FIG. 1 (RELATED ART)
FIG. 1 is a cross-sectional view of a conventional fusing unit.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

A fusing unit according to an example embodiment of the present invention is formed on a printing path of an image forming apparatus, and fuses a toner image transferred to a printing medium.

Figure 2:
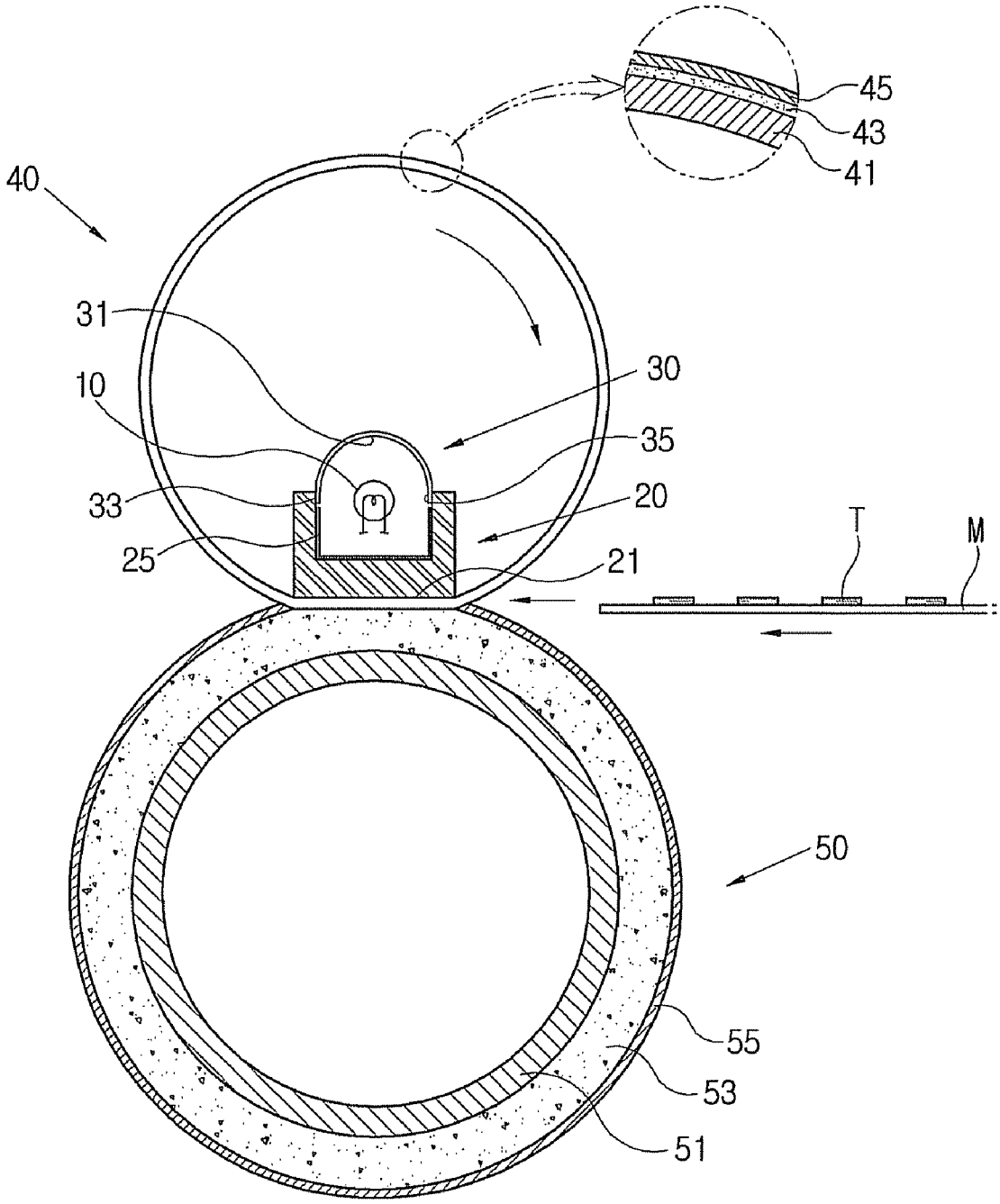
FIG. 2 is a cross-sectional view of a fusing unit according to an example embodiment of the present invention.

As shown in FIG. 2, a fusing unit according to an example embodiment of the present invention includes a heat source 10, a nip plate 20, a reflection member 30, a belt member 40 and a driving roller 50.

The heat source 10 generates radiant heat to heat the nip plate 20. The heat source 10 may include a lamp, e.g., a halogen lamp or a resistance heating element, which is provided in a space on the nip plate 20. The nip plate 20 is heated by the heat source 10, and includes a nip part 21 which heats and presses a printing medium M that is to be fused. The nip plate 20 presses the printing medium M which is fed, together with the driving roller 50, thereby fusing a toner image T to the printing medium M in the overall area of a fusing nip having a width corresponding to that of the nip part 21.

The nip plate 20 may further include a heat absorbing layer 25 which is formed on a surface thereof facing the heat source 10. The heat absorbing layer 25 is formed by black plating, and enhances a heat absorption rate of the nip plate 20, thereby further raising a fusing temperature. FIG. 2 further illustrates the belt member 40, which includes a base layer 41, a first elastic layer 43, and a first release layer 45.

Preferably but not necessarily, the reflection member 30 has a closed structure and is formed on a side of the nip plate 20. To this end, the reflection member 30 includes a heat reflecting surface 31 which faces the nip part 21 and satisfies the below-described condition of Formula 1, and coupling parts 33 and 35 which are coupled with the nip plate 20 to form a closed structure.

The belt member 40 is rotatably provided about an external surface of the heat source 10, the nip plate 20 and the reflection member 30. The belt member 40 is driven by the driving roller 50 and guides the movement of the printing medium M. Thus, the toner image T which is formed on the printing medium M is not damaged while being fused.

The belt member 40 may include the base layer 41, the first elastic layer 43 which is formed on a surface of the base layer 41 facing the driving roller 50, and the first release layer 45 which is formed on an external surface of the first elastic layer 43. The first elastic layer 43 prevents the printing medium M from adhering thereto while the toner image T is fused to the printing medium M.

The base layer 41 may include a high molecular weight material such as polyimide (PI) or polyetheretherketone (PEEK), nickel or an alloy thereof, stainless steel, aluminum or an alloy thereof, copper or an alloy thereof.

The driving roller 50 is disposed to face the nip part 21 of the nip plate 20, having the belt member 40 disposed therebetween. The driving roller 50 rotatably drives the belt member 40, and forms the fusing nip by pressure between the nip part 21 and the driving roller 50. The driving roller 50 may include a core pipe 51, a second elastic layer 53 which is formed on the circumference of the core pipe 51, and a second release layer 55 which is formed on a surface of the second elastic layer 53. The second elastic layer 53 is elastically deformed to form the fusing nip corresponding to the shape of the nip plate 20. The second release layer 55 prevents the printing medium M from being adhered thereto while being fused. The core pipe 51 may include stainless steel, iron, aluminum, copper, or an alloy thereof, ceramics, FRM, and the like.

The first and second elastic layers 43 and 53 may include silicone rubber, fluoric rubber, and the like. The silicone rubber may include polydimethyl silicone rubber, metal vinyl silicone rubber, metal phenyl silicone rubber, fluoric silicone rubber, and the like. The first and second release layers 45 and 55 may include fluoric rubber, silicone rubber, fluororesin, and the like.

Figure 3A:
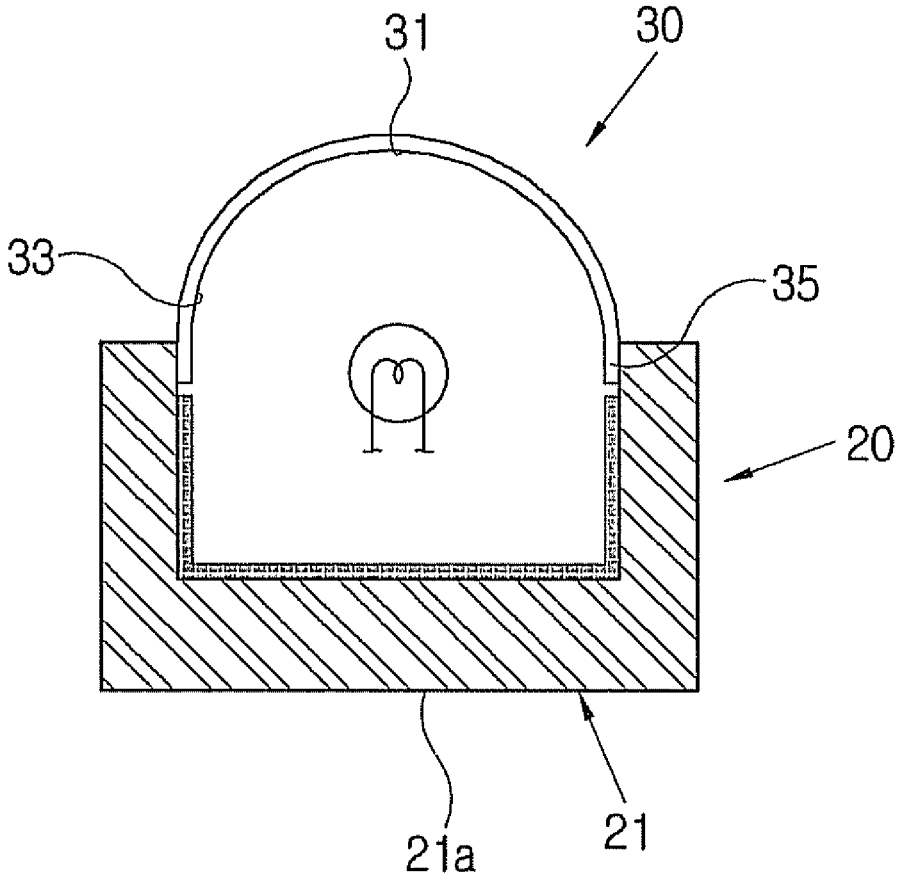
FIGS. 3A to 3C are cross-sectional views of example embodiments of a nip part of a nip plate according to aspects of the present invention.
Figure 3B:
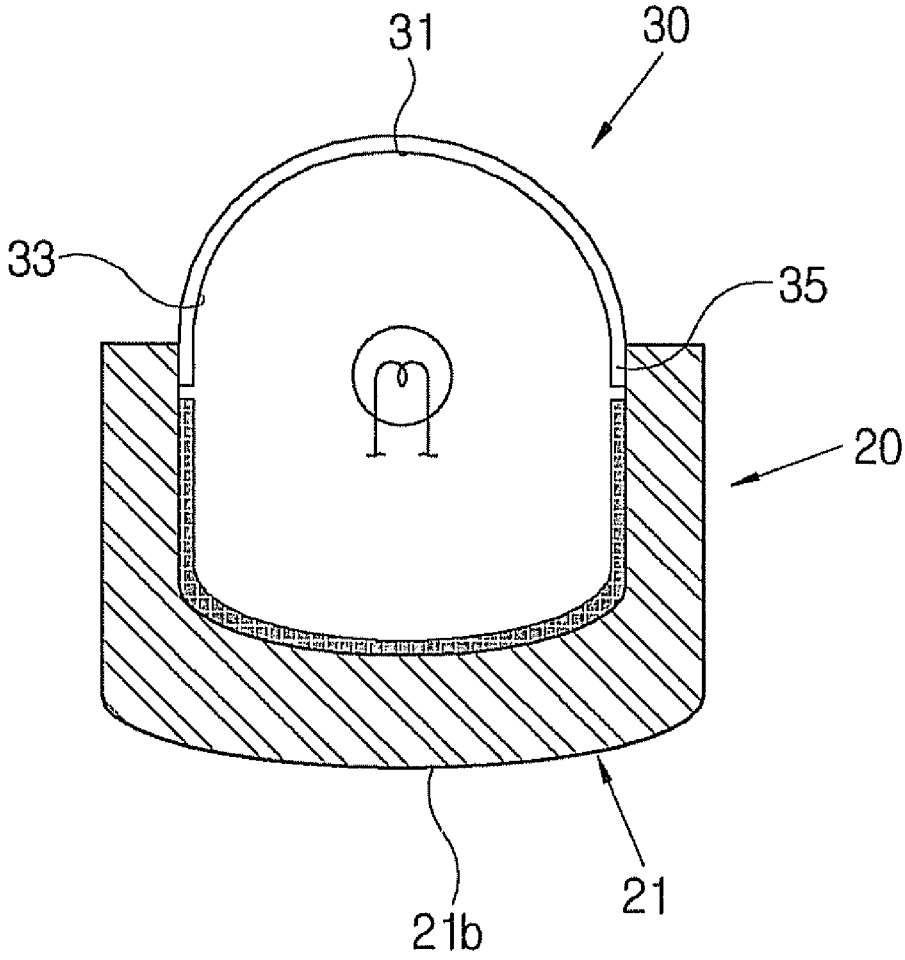
Figure 3C:
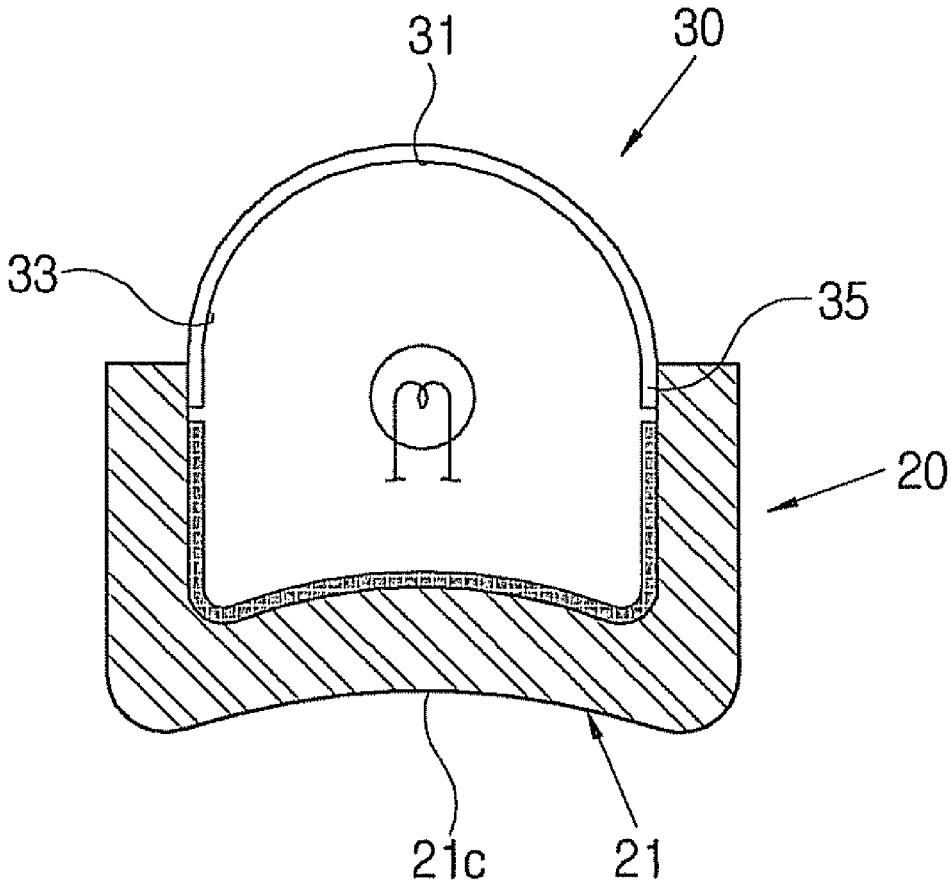

As shown in FIGS. 3A to 3C, respectively, the nip part 21 may have one of a flat shape 21*a*, a convex shape 21*b*, and a concave shape 21*c*. The shape of the nip part 21 is determined according to the width of and pressure distribution in the fusing nip formed between the driving roller 50 and the belt member 40 formed in a circumference of the nip part 21.

If the nip part 21 has the flat shape 21*a* as shown in FIG. 3A, the fusing nip has a shape corresponding to that of the nip part 21, and the printing medium M proceeds without bending during or after being fused. Although the flat shape 21*a* is illustrated as having two parallel sides, the nip part 21 is not limited thereto such that the two sides need not be parallel. For example, the area of the nip plate 20 in which the heat absorbing layer 25 is formed may be parallel or not parallel to the nip part 21 that has a flat shape 21*a*.

If the nip part 21 has the convex shape 21*b*. i.e., convex toward the driving roller 50 as shown in FIG. 3B, the fusing nip has a shape corresponding to that of the nip part 21. As such, the pressing force of the nip plate 20 is uniformly supplied to the overall area of the fusing nip, and the nip part 21 is radially arranged with respect to the heat source 10, thereby maintaining uniform fusing temperature throughout the overall area of the fusing nip. The convex shape 21*b* of the nip part 21 may raise the fusing efficiency.

If the nip part 21 has the concave shape 21*c* toward the driving roller 50 as shown in FIG. 3C, the fusing nip has a shape corresponding to that of the nip part 21. After being fused, the printing medium M advances toward the driving roller 50 while being bent along the concave shape 21*c* of the nip area of the nip part 21. Thus, there may be prevented a wrap jam in which the printing medium M wraps about the belt member 40. Although the nip part 21 and the nip plate 20 are illustrated as having parallel surfaces or concentric shapes, the nip part 21 and the nip plate 20 are not limited thereto such that, for example, the nip part 21 may have a convex shape while the surface of the nip plate 20 facing the heat source may have a concave or flat shape.

Figure 4:
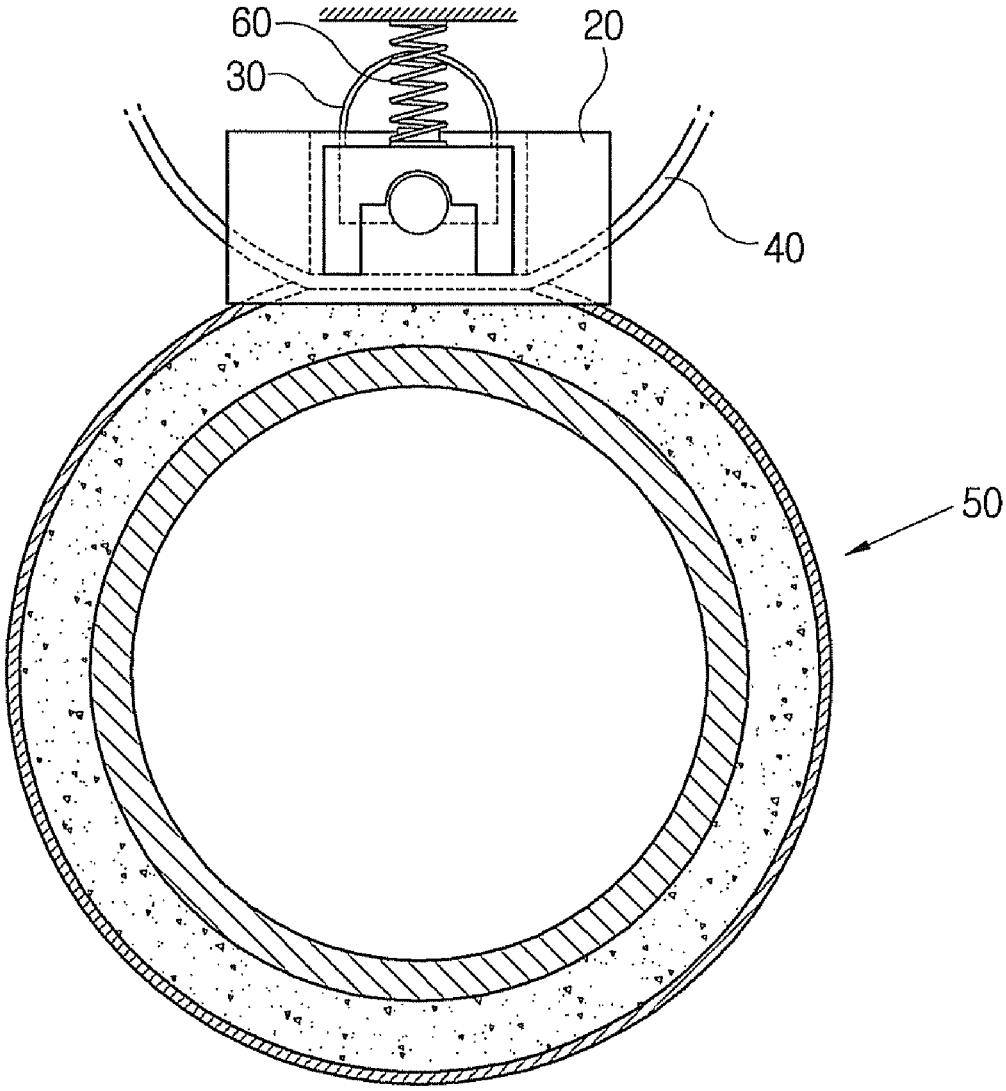
FIG. 4 is a cross-sectional view of a fusing unit according to a second example embodiment of the present invention.

Referring FIG. 4, the fusing unit according to aspects of the present invention may further include an elastic member 60, such as a spring or other biasing device, which elastically presses the nip plate 20 to the driving roller 50. The elastic member 60 elastically presses the opposite ends of the nip plate 20, thereby pressing the nip plate 20 toward the driving roller 50, to form the fusing nip between the nip part 21 and the driving roller 50. The fusing nip has a width corresponding to a width of the nip part 21 (not shown).

Alternatively, the elastic member 60 may be provided in the driving roller 50 to elastically press the driving roller 50 to the nip plate 20, or may be provided to elastically press both the driving roller 50 and the nip plate 20 toward the other.

The reflection member 30 is formed on a side of the nip plate 20, i.e., on an opposite side of the nip part 21, and reflects heat generated by the heat source 10 toward the nip plate 20, thereby focusing the heat of the heat source 10 to the nip part 21. To enhance reflection efficiency, the reflection member 30 may be formed of stainless steel, aluminum, copper or an alloy thereof, ceramics or a fiber reinforced metal (FRM). Alternatively, a surface of the reflection member 30 facing the heat source 10 may be coated with the foregoing materials.

Figure 5A:
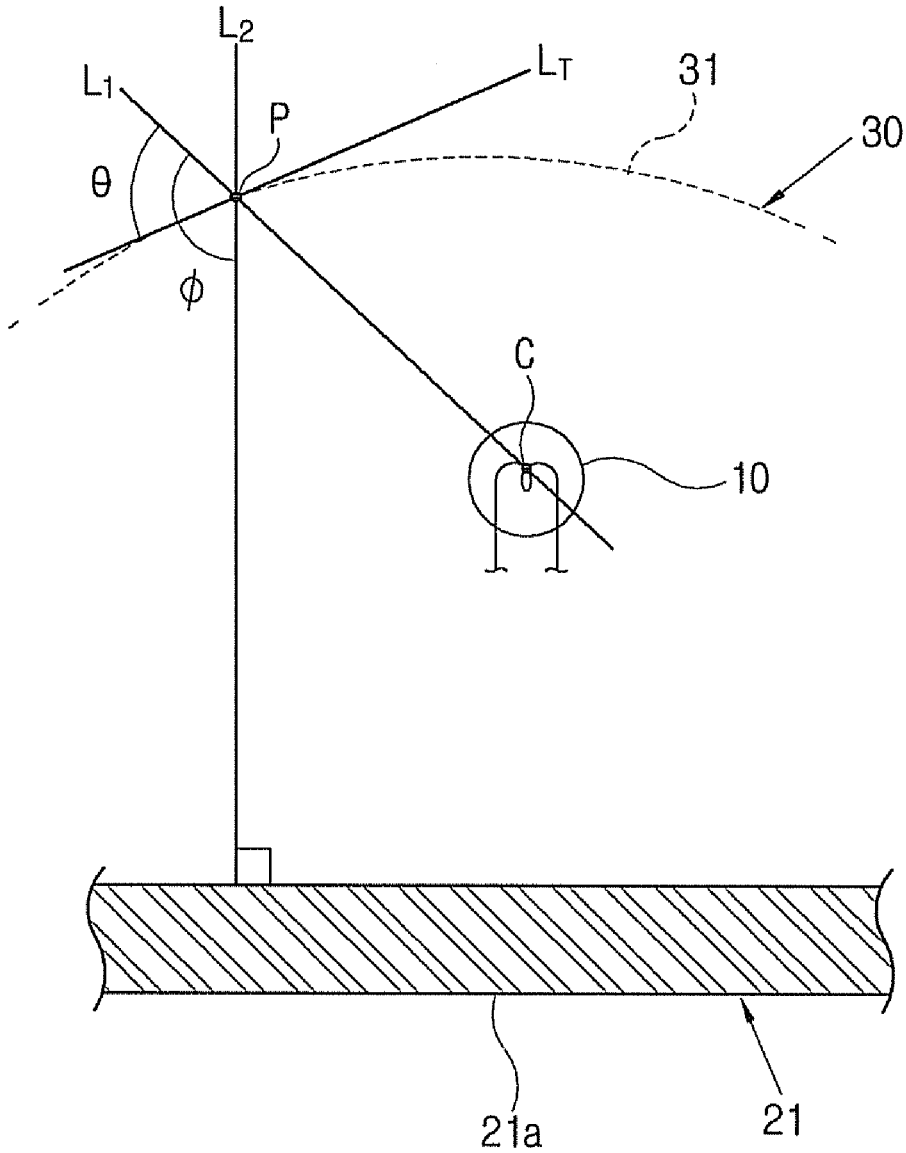
FIGS. 5A to 5C illustrate a reflection member in FIGS. 3A to 3C, respectively.
Figure 5B:
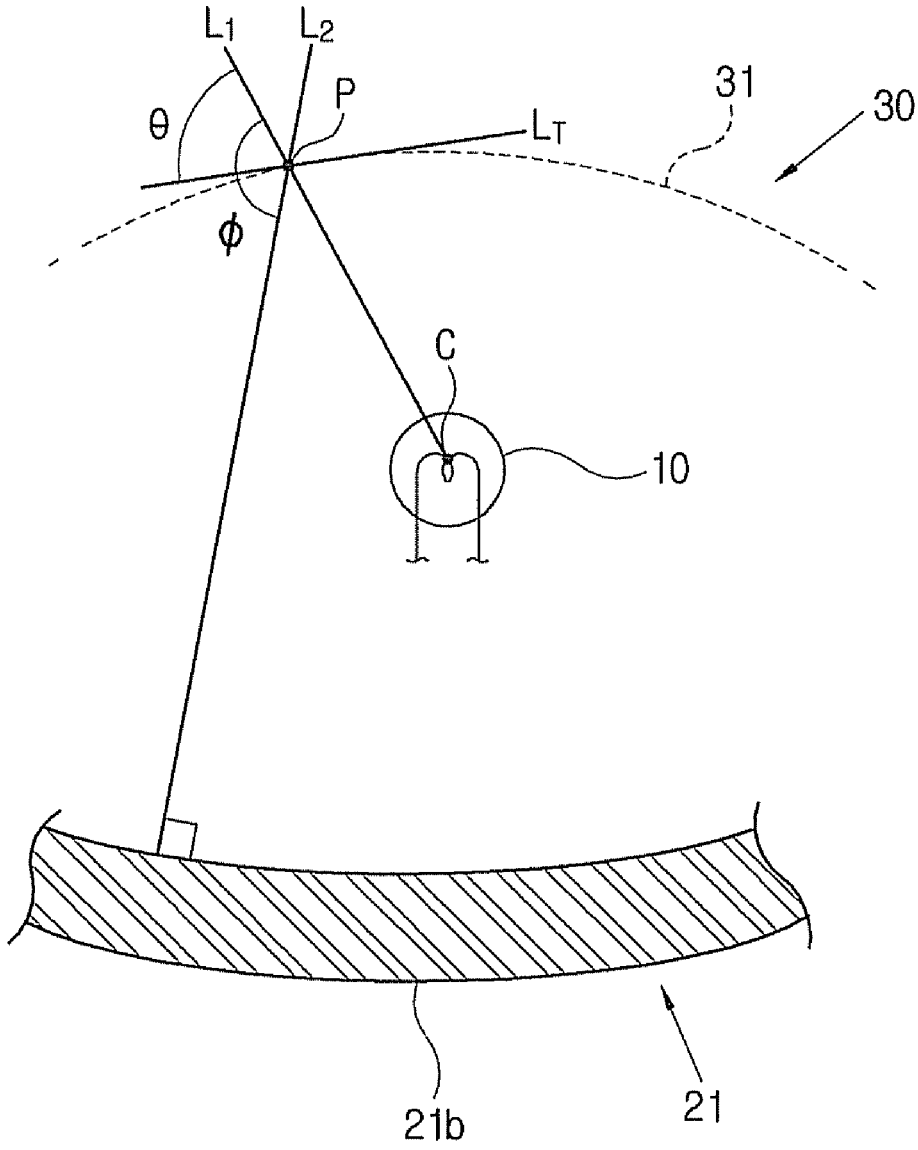
Figure 5C:
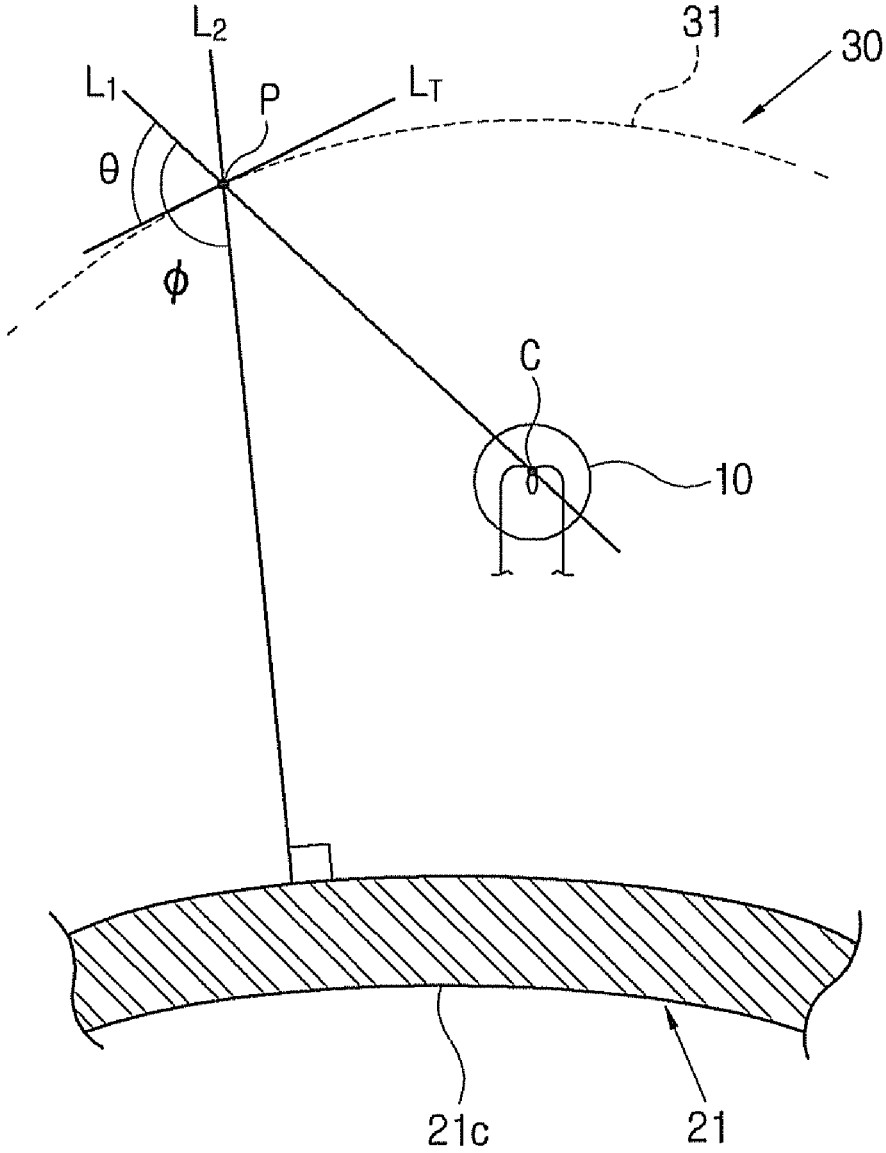

To mount the reflection member 30 in the nip plate 20, a valid curvature condition of the heat reflecting surface 31 of the reflection member 30 may satisfy the following Formula 1. FIGS. 5A to 5C illustrate an arrangement of the reflection member 30 which satisfies the Formula 1 when the nip plate 20 includes the reflection member 30 as shown in FIGS. 3A to 3C, respectively.

$$\phi/2-15^\circ \leqq \theta \leqq \phi/2+15^\circ \qquad \text{[Formula 1]}$$

As shown in FIGS. 5A to 5C, $L_1$ is a straight line which connects an arbitrary position P on the heat reflecting surface 31, meeting the valid curvature condition, of the reflection member 30 and a center C of the heat source 10. $L_2$ is a straight line which crosses the arbitrary position P on the reflection member 30 and is vertical or perpendicular to the nip part 21. $\phi$ is an obtuse angle formed between the straight lines $L_1$ and $L_2$. $\theta$ is an acute angle formed between a tangent line $L_T$ tangent to the reflection member 30 at the arbitrary position P on the reflection member 30 and crossing the straight line $L_1$.

The reason why the reflection member 30 is arranged to satisfy Formula 1 is as such: light or heat may be vertically incident to the surface of the nip plate 20 enhances an absorption intensity of the reflected light or heat by the nip plate 20. If the shape of the reflection member 30 is determined to satisfy $\theta=\phi/2$ in setting the straight lines L1 and L2, $\phi$ and $\theta$ at the arbitrary position P (and every arbitrary position P), heat becomes vertically incident to the nip part 21 of the nip plate 20. Then, the heat absorption is maximally increased since heat is vertically incident to the nip part 21 of the nip plate 20. FIG. 5A illustrates the application of heat from the heat source 10 to the nip part 21 according to the above-described condition when the nip part 21 has the flat shape 21*a*. FIG. 5B illustrates the application of heat from the heat source 10 to the nip part 21 according to the above-described condition when the nip part 21 has the convex shape 21*b*. FIG. 5C illustrates the application of heat from the heat source 10 to the nip part 21 according to the above-described condition when the nip part 21 has the concave shape 21*c*.

Figure 6:
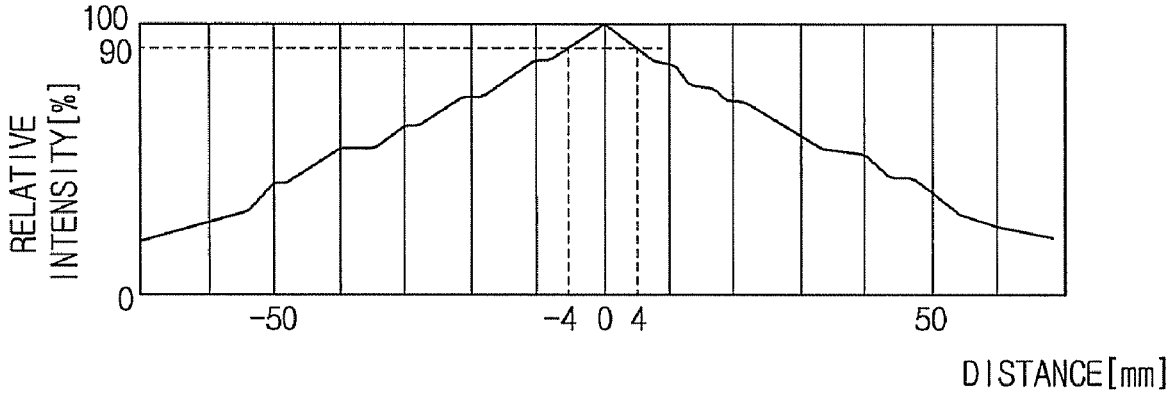
FIG. 6 is a graph which illustrates the variation of the relative intensity of light depending on an incident position.

FIG. 6 is a graph which illustrates relative intensity variation of light or heat depending on an incident position and the angle of reflection of the light or heat. Here, a distance from the heat source 10 to an incident surface of the nip plate 20 is 15 mm and the intensity of radiant rays reflected from the reflection member 30 and vertically incident to the nip part 21 is 100%.

As shown in FIG. 6, the radiant rays maintain an intensity of 90% or above within ±4 mm of the incident position which is illustrated as a dotted line, which corresponds to ±15° if being converted into an angle. Thus, the reflection member 30 may satisfy the Formula 1 to secure 90% or more intensity of the radiant rays. Then, the nip plate 20 is intensively heated to raise the fusing temperature appropriate for the fusing condition.

Hereinafter, temperature increase rates of the nip part 21 of the nip plate 20 according to time in the example embodiment and comparative examples will be compared with reference to Table 1 and FIG. 7.

Table 1 presents time necessary to reach 100° C. and temperature increase rate in the example embodiment and the comparative examples 1 and 2. FIG. 7 is a graph which illustrates the temperature increase rates according to time elapse in the example embodiment and the comparative examples 1 and 2.

TABLE 1

| | Time to reach 100° C. (sec) | Temperature increase rate (° C./sec) |
|---|---|---|
| Example embodiment | 0.9 | 83.3 |
| Comparative example 1 (FIG. 1) | 5.3 | 14.2 |
| Comparative example 2 | 2.0 | 37.5 |

Figure 7:
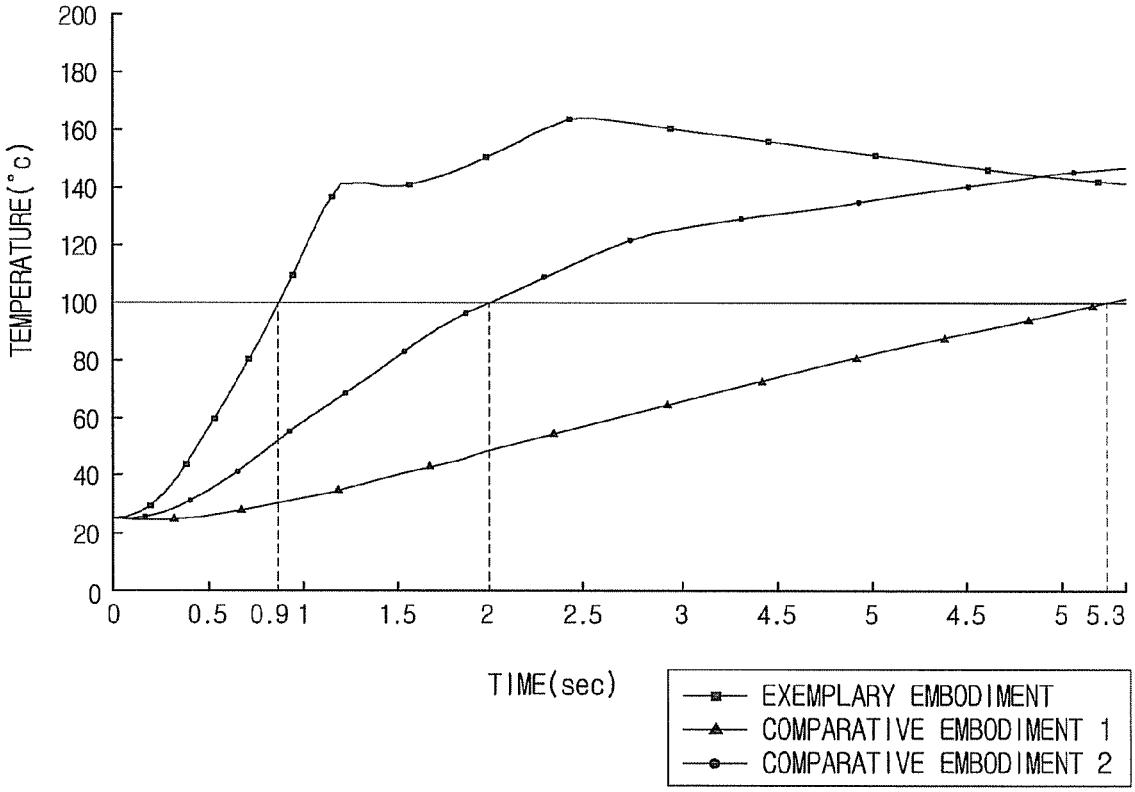
FIG. 7 is a graph which illustrates a temperature increase rate according to time elapse in the example embodiment and comparative examples.

As shown in Table 1 and FIG. 7, the time necessary to reach 100° C. in the comparative example 1, as illustrated in FIG. 1, is 5.3 seconds if the fusing roller and the pressing roller are provided as shown in FIG. 1. Meanwhile, the time necessary to reach 100° C. in the comparative example 2 is 2.0 seconds if other elements are the same as those in the example embodiment except with no reflection member included in the fusing unit.

The time necessary to reach 100° C. in the example embodiment of the present invention is 0.9 second, which is significantly decreased from those in the comparative examples 1 and 2.

In the example embodiment of the present invention, the time for raising the temperature of the fusing unit to the fusing temperature is significantly reduced compared to those of the comparative examples 1 and 2, thereby enhancing efficiency in raising the temperature of the fusing unit to the fusing temperature and drastically reducing the warm-up time of the fusing unit.

Figure 8:
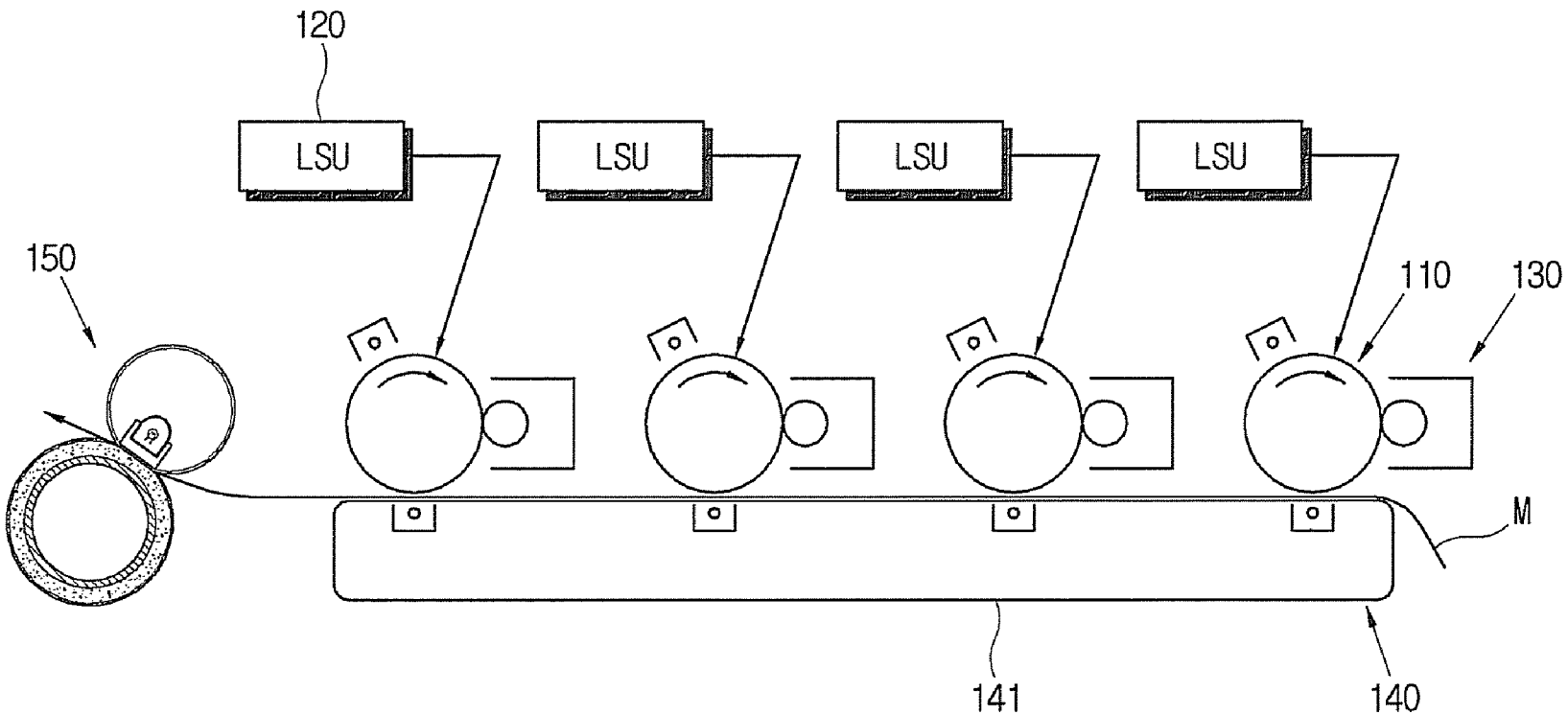
FIG. 8 is a schematic sectional view of an image forming apparatus according to an example embodiment of the present invention.

As shown in FIG. 8, an image forming apparatus according to an example embodiment of the present invention includes a photosensitive body 110, a light scanning unit (LSU) 120 which scans light to the photosensitive body 110 to form an electrostatic latent image, a developing unit 130 which develops a toner image with respect to the electrostatic latent image formed on the photosensitive body 110, a transfer unit 140 which transfers the toner image formed by the developing unit 130 to a printing medium M, and a fusing unit 150 which fuses a toner image transferred to the printing medium M.

FIG. 8 illustrates a tandem-type color image forming apparatus which includes a plurality of the photosensitive bodies 110, light scanning units 120 and developing units 130. The color image forming apparatus may have a plurality of light scanning units 120 and developing units 130 such that one light scanning unit 120 and one developing unit 130 correspond to each color required to form the color image. Such colors may include magenta, yellow, cyan, and black. The plurality of light scanning units 120 and the plurality of developing units 130 are disposed along a moving path of the printing medium M. However, the color image forming apparatus is not limited thereto such that the image forming apparatus may include only one photosensitive body 110 to deliver one color to a printing medium M or may deliver several colors to the printing medium M with only one photosensitive body 110.

The transfer unit 140 faces the plurality of photosensitive bodies 110, to allow the printing medium M to move through the moving path between the photosensitive bodies 110 and the transfer unit 140. The transfer unit 140 transfers the toner image formed on the photosensitive bodies 110 to the printing medium M. The transfer unit 140 also includes a transfer belt 141 which faces the plurality of photosensitive bodies 110 and moves the printing medium M along the moving path so as to provide for the application of each of the colors.

The fusing unit 150 includes a heat source, a nip plate, a reflection member and a driving roller as described above. The nip plate is heated to a fusing temperature by radiant rays reflected from the heat source directly and indirectly, and fuses the toner image transferred to the printing medium M by pressing against the driving roller. The configuration and operation of the fusing unit 150 are substantially equivalent to those of the fusing unit according to the example embodiments of the present invention. Thus, the detailed description thereof will be avoided here.

As described above, a fusing unit according to aspects of the present invention includes a nip plate and a belt member instead of a fusing roller, and provides a small size to secure a toner image to a printing medium through a fusing nip to fuse an image. The fusing unit part includes a reflection member to intensively heat the nip part of the nip plate, thereby reducing the time necessary to raise the temperature to the fusing temperature, and reducing warm-up time of the image forming apparatus.

The image forming apparatus according to the aspects present invention employs a fusing unit to intensively heat a nip part and enhance fusing performance, thereby providing a high quality image.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing unit which is formed on a printing path of an image forming apparatus and fuses an image to a printing medium, the fusing unit comprising:

a heat source;

a nip plate which is heated by the heat source, and comprises a nip part to heat and press the printing medium;

a reflection member including a heat reflecting surface which is formed on a side of the nip plate and reflects heat generated by the heat source toward the nip part;

a belt member which is rotatably provided about the heat source, the nip plate and the reflection member, and guides the movement of the printing medium; and a driving roller, which faces the nip part to form a fusing nip between the nip part and the driving roller corresponding to a width of the nip part, disposed such that the belt member is between the nip plate and the driving roller, and the driving roller rotatably drives the belt member, wherein the heat reflecting surface of the reflection member satisfies a curvature condition according to Formula 1, Formula 1 being $\phi/2-15° \leqq \theta \leqq \phi/2+15°$, where $L_1$ is a straight line between an arbitrary position on the reflection member and a center of the heat source, $L_2$ is a straight line which crosses the arbitrary position on the reflection member and is vertical to the nip part, $\phi$ is an obtuse angle formed between the straight lines $L_1$ and $L_2$, and $\theta$ is an acute angle formed between a line tangent to the reflection member at the arbitrary position on the reflection member and the straight line $L_1$.

2. The fusing unit according to claim 1, wherein the nip plate further comprises a heat absorbing layer which is formed on a surface thereof facing the heat source and enhances a heat absorption rate.

3. The fusing unit according to claim 1, further comprising an elastic member which elastically presses at least one of the nip plate and the driving roller toward the other of the nip plate and the driving roller to form the fusing nip between the nip part and the driving roller.

4. The fusing unit according to claim 1, wherein the belt member comprises:

a base layer;

an elastic layer which is formed on an external surface of the base layer; and a release layer which is formed on an external surface of the elastic layer to prevent the printing medium from adhering thereto while being fused.

5. The fusing unit according to claim 1, wherein the driving roller comprises:

a core pipe;

an elastic layer which is formed on an external surface of the core pipe; and a release layer which is formed on an external surface of the elastic layer to prevent the printing medium from adhering thereto while being fused.

6. The fusing unit according to claim 1, wherein the nip part comprises one of a flat shape, a convex shape, and a concave shape.

7. The fusing unit according to claim 1, wherein the reflection member further comprises a coupling part to couple the nip plate and the reflection member and to form a closed fusing unit.

8. An image forming apparatus, comprising:

a photosensitive body;

a light scanning unit which scans light on the photosensitive body and forms an electrostatic latent image thereon;

a developing unit which develops a toner image with respect to the electrostatic latent image formed on the photosensitive body;

a transfer unit which moves a printing medium past the photosensitive body to transfer the toner image formed by the developing unit to the printing medium; and the fusing unit according to claim 1 which fuses the transferred toner image to the printing medium.

9. The image forming apparatus according to claim 8, wherein the nip plate further comprises a heat absorbing layer which is formed on a surface thereof facing the heat source and enhances a heat absorption rate.

10. The image forming apparatus according to claim 8, further comprising an elastic member which elastically presses at least one of the nip plate and the driving roller toward the other of the nip plate and the driving roller to form the fusing nip between the nip part and the driving roller.

11. The image forming apparatus according to claim 8, wherein the belt member comprises:

a base layer;

an elastic layer which is formed on an external surface of the base layer; and a release layer which is formed on an external surface of the elastic layer to prevent the printing medium from adhering thereto while being fused.

12. The image forming apparatus according to claim 8, wherein the driving roller comprises:

a core pipe;

an elastic layer which is formed on a circumference of the core pipe; and a release layer which is formed on a surface of the elastic layer to prevent the printing medium from adhering thereto while being fused.

13. The image forming apparatus according to claim 8, wherein the nip part comprises one of a flat shape, a convex shape, and a concave shape.

14. The image forming apparatus according to claim 8, wherein the reflection member further comprises a coupling part to couple the nip plate and the reflection member and to form a closed fusing unit.

15. A fusing unit for an image forming apparatus to fuse a toner image to a printing medium, the fusing unit comprising:

a heat source to generate heat;

a nip plate to accept heat from the heat source on a first side and comprising a nip part formed on a second side of the nip plate, the second side being opposite the first side;

a reflection member having a heat reflecting surface; and coupling parts to couple the reflection member to the nip plate, wherein the heat reflecting surface reflects the heat generated by the heat source to the first side of the nip plate to intersect the first side at an angle of about 90 degrees.

16. The fusing unit of claim 15, wherein the nip plate further comprises a heat absorbing layer disposed on the first side of the nip plate to accept the heat generated by the heat source.

17. The fusing unit of claim 15, wherein the nip part is one of a flat shape, a convex shape, and a concave shape.

18. A fusing unit for an image forming apparatus, the fusing unit comprising:

a heat source to produce a fusing temperature;

a nip plate to transfer the heat associated with the fusing temperature to a toner image formed on a printing medium through a nip part;

a reflection member to reflect heat generated by the heat source to the nip plate at an angle so that an intensity of the heat reaching the nip plate is about 90% of the intensity of heat reaching the nip plate at a 90 degree angle, wherein the reflection member and the nip plate are coupled to form a closed fusing unit.

19. The fusing unit of claim 18, further comprising a belt member disposed about the reflection member and the nip plate to guide the movement of the printing medium through the fusing unit.

20. The fusing unit of claim 19, further comprising a driving roller to form a fusing nip with the belt member in an area corresponding to the nip part.

* * * * *